United States Patent [19]

Hasebe et al.

[11] 4,200,388

[45] Apr. 29, 1980

[54] TONER DENSITY SENSOR FOR ELECTROSTATIC COPYING MACHINE

[75] Inventors: Mitsuo Hasebe; Mutsuo Watanabe; Kunio Hibi; Masayosi Watanuki, all of Tokyo, Japan

[73] Assignee: Ricoh Company, Ltd., Tokyo, Japan

[21] Appl. No.: 851,904

[22] Filed: Nov. 16, 1977

[30] Foreign Application Priority Data

Dec. 8, 1976 [JP] Japan ..... 51-147272

[51] Int. Cl.[2] ..... G03G 15/00

[52] U.S. Cl. ..... 355/3 DD; 118/712; 222/DIG. 1; 324/200

[58] Field of Search ..... 355/3 R, 3 DD; 118/646; 222/DIG. 1; 324/200, 219, 220

[56] References Cited

U.S. PATENT DOCUMENTS

| | | | |
|---|---|---|---|
| 3,802,381 | 4/1974 | O'Neill et al. | 118/646 X |
| 3,896,279 | 7/1975 | Sugawara | 222/DIG. 1 X |

*Primary Examiner*—Fred L. Braun

*Attorney, Agent, or Firm*—Jordan and Hamburg

[57] ABSTRACT

A toner mixture comprising ferromagnetic carrier particles and non-magnetic toner particles are caused to flow through a conduit for measuring the toner density which is the ratio of toner particles to carrier particles in the mixture. The effective inductance of an electromagnetic coil disposed in the conduit varies in accordance with toner density. The coil is designed so that the magnetic lines of force thereof are substantially confined within the conduit and are not influenced by external bodies.

5 Claims, 4 Drawing Figures

TONER DENSITY SENSOR FOR ELECTROSTATIC COPYING MACHINE

BACKGROUND OF THE INVENTION

The present invention relates to an improved toner density sensor for an electrostatic copying machine or the like.

A developing or toner mixture for use in an electrostatic copying machine comprises ferromagnetic carrier particles and colored, non-magnetic toner particles. In a black and white copying machine the toner particles are black. A photoconductive drum is electrostatically charged and radiated with a light image of an original document to form an electrostatic image through localized photoconduction. The toner mixture is applied to the drum to develop the electrostatic image into a toner image. The toner image is transferred and fixed to a copy sheet to provide a permanent reproduction of the original document.

The toner mixture is agitated so that the smaller toner particles adhere to the larger carrier particles due to an electrostatic charge induced on the toner particles by friction, that is, due to a triboelectricity. The toner mixture is applied to a rotating cylinder inside which are provide magnets which attract the carrier particles and adhered toner particles to the cylinder to form a magnetic brush. The magnetic brush is brushingly engaged with the drum and the toner particles are attracted and adhered to the drum in the areas of high electrostatic charge to form the toner image. The carrier particles remain adhered to the cylinder and are recycled along with those toner particles which are not consumed in the developing process. Typically, the charge on the drum has a polarity opposite to that on the toner particles to maximize the attractive effect.

The toner density is defined as the ratio or relative proportion of toner particles to carrier particles in the toner mixture, and decreases due to the consumption of toner particles in the developing process. In order to maintain sufficient copy density, it is necessary to add toner particles to the toner mixture at the same rate at which the toner particles are consumed during development. Since the toner consumption rate varies in accordance with the type of original document being copied, it is necessary to sense or measure the toner density in a continuous manner in order to properly regulate the toner replenishment rate.

Such a sensor has been developed which comprises a conduit through which the recycled toner mixture is caused to flow downwardly by gravity and a coil wound around a portion of the conduit. The effective inductance of the coil varies in accordance with the toner density, since the toner mixture in the conduit constitutes a core of the coil. The lower the toner density and correspondingly the higher the proportion of ferromagnetic carrier particles in the toner mixture, the higher the effective inductance of the coil. The effective inductance of the coil is determined by passing a suitable electric current therethrough, preferably alternating current, and measuring the current flow as a function of the effective impedance of the coil. Alternately, the coil may be connected in parallel with a capacitor to constitute a resonant circuit of an oscillator, the inductance of the coil being determined as a function of the resonant frequency of the oscillator.

Although such a sensor arrangement generally functions to measure the toner density, it suffers from two serious drawbacks. Firstly, since the coil is located outside the conduit, only a relatively small portion of the magnetic field thereof permeates the toner mixture inside the conduit. Since only a portion of the magnetic field of the coil is influenced by the toner mixture, the sensitivity of the sensor to variations in toner density is rather poor.

As another drawback, the portion of the magnetic field of the coil external to the conduit is subject to influence by various factors such as toner dust in the atmosphere immediately surrounding the coil and conduit which settles on the exterior of the coil. Even if the radius of the coil is made smaller than 20–30 mm, the lines of magnetic flux extend external therefrom for a distance of some 20–40 mm. The influence of carrier particles in the toner dust external of the coil may become greater than that of the toner mixture in the conduit, rendering the sensor completely inaccurate and useless for its intended purpose.

SUMMARY OF THE INVENTION

The present invention overcomes the above mentioned drawbacks of the prior art by providing an electromagnetic coil inside a conduit. The coil is configured so that the magnetic field thereof is substantially confined within the conduit, thereby eliminating the influence of toner dust or other ferromagnetic materials external of the conduit on the effective inductance of the coil. Due to the fact that the entire magnetic field of the coil permeates the toner mixture, the toner density measurement sensitivity is greatly increased.

It is an object of the present invention to provide a toner density sensor for an electrostatic copying machine or the like of greatly increased sensitivity compared to the prior art.

It is another object of the present invention to provide a toner density sensor which is substantially immune to external influences such as an accumulation of toner dust on the sensor.

It is another object of the present invention to provide a generally improved toner density sensor for an electrostatic copying machine or the like.

Other objects, together with the foregoing, are attained in the embodiments described in the following description and illustrated in the accompanying drawing.

DESCRIPTION OF THE PREFERRED EMBODIMENTS

While the toner density sensor of the invention is susceptible of numerous physical embodiments, depending upon the environment and requirements of use, substantial numbers of the herein shown and described embodiments have been made, tested and used, and all have performed in an eminently satisfactory manner.

Figure 1:
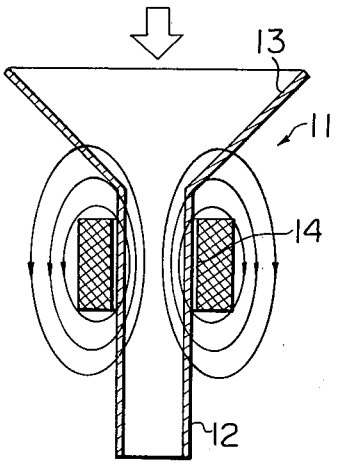
Fig. 1 PRIOR ART
FIG. 1 is a vertical sectional view of a prior art toner density sensor.

Referring now to FIG. 1 of the drawing, a prior art toner density sensor is generally designated as 11 and comprises a conduit 12. The upper end of the conduit 12 is flared to constitute a funnel 13. Recycled toner mixture in an electrostatic copying machine (now shown) is introduced into the funnel 13 and allowed to flow downwardly through the conduit 12 under the influence of gravity. An electromagnetic coil 14 is wound around a portion of the conduit 12.

Due to the ferromagnetic carrier particles in the toner mixture flowing through the conduit 12 which effectively constitute a core of the coil 14, the effective inductance of the coil 14 varies in accordance with the relative proportion of toner particles to carrier particles in the toner mixture, or the toner density. The higher the toner density, the lower the effective inductance. The inductance of the coil 14 is determined by measuring the effect of the coil 14 on an alternating electric current passed therethrough.

The magnetic lines of force developed by the coil 14 during one alternation of the alternating current passing therethrough are indicated by arrows, and have a toroidal shape. Only those lines which pass through the conduit 12, which is made of a non-magnetic material, are influenced by the toner mixture. However, toner dust accumulated on the exterior of the coil 14 and the portions of the conduit 12 closely adjacent thereto has a major effect on the lines of force external of the conduit 12 and thereby the inductance of the coil 14. This gives rise to the undesirable effects described in detail hereinabove.

Figure 2:
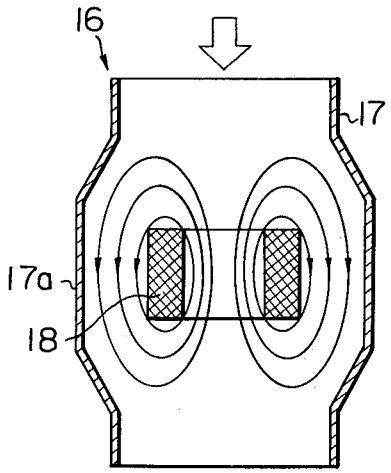
FIG. 2 is a vertical sectional view of a first embodiment of a toner density sensor according to the present invention.

These problems are overcome in a toner density sensor 16 embodying the present invention which is shown in FIG. 2 and comprises a non-magnetic cylindrical conduit 17 through which toner mixture flows due to gravity. A coil 18 having a hollow, cylindrical cross-section is supported inside the conduit 17 by suitable means which are not shown in such a manner that the coil 18 is coaxial with the conduit 17. Moreover, the outer diameter of the coil 18 is smaller than the inner diameter of the conduit 17 so that toner mixture is caused to flow around and through the coil 18. As indicated by arrows, the magnetic lines of force of the coil 18 have a toroidal shape and are completely confined inside the conduit 17. As indicated at 17*a*, the portion of the conduit 17 in which the coil 18 is disposed may have an enlarged cross-section to ensure that the lines of force of the coil 18 are confined inside the portion 17*a*. The amount of enlargement of the portion 17*a* is a function of the length diameter and number of turns of the coil 17 as well as the magnitude of current flow therethrough.

Since all of the magnetic lines of force permeate the toner mixture in the conduit 17, the sensitivity of the sensor 16 is much greater than that of the sensor 11. Moreover, the sensor 16 is not influenced by toner dust on the outside of the conduit 18 since the magnetic lines of force of the coil 18 are confined inside the conduit 17 and do not permeate the toner dust.

Figure 3:
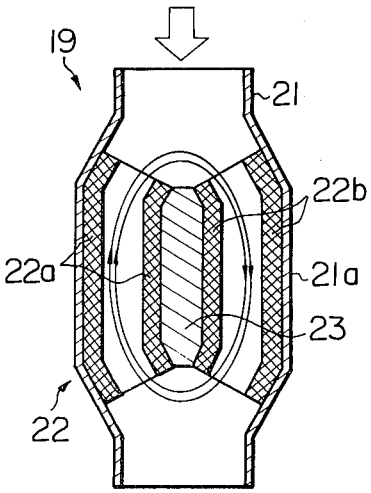
FIG. 3 is a vertical sectional view of a second embodiment of a toner density sensor according to the present invention.

A second toner density sensor 19 embodying the present invention is illustrated in FIG. 3 and comprises a vertically oriented non-magnetic conduit 21, a portion of which has an enlarged cross-section as indicated at 21*a*. The cross-section of the conduit 21 is preferably rectangular and is elongated perpendicular to the plane of the drawing, although not illustrated. Inside the portion 21*a* is provided a coil 22 comprised of two coil sections 22*a* and 22*b* respectively.

Figure 4:
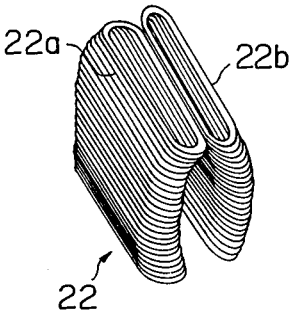
FIG. 4 is a perspective view of an electromagnetic coil of the embodiment of FIG. 3.

The coil sections 22*a* and 22*b* are symmetrically transversely disposed in the conduit 21 as illustrated, with axes of the coil sections 22*a* and 22*b* being generally parallel to an axis of the conduit 21. The coil sections 22*a* and 22*b* are hollow, but flattened, and are elongated generally parallel to the axis of the conduit 21. The coil sections 22*a* and 22*b* are convexly curved away from each other and the transversely outer surfaces thereof are flush with the conjugate inner surfaces of the conduit 21. A spacer 23 is provided between the coil sections 22*a* and 22*b* to prevent toner mixture from flowing therebetween. Toner mixture is further prevented from flowing around the coil sections 22*a* and 22*b* due to engagement thereof with the inner surfaces of the conduit 21. The coil sections 22*a* and 22*b* are illustrated in perspective in FIG. 4.

As best illustrated in FIG. 3, the coil sections 22*a* and 22*b* are connected in such a manner that current flow therethrough will produce magnetic lines of force as shown. More specifically, the lines of force of the coil sections 22*a* and 22*b* extend in opposite directions generally parallel to the axis of the conduit 21 respectively and combine to form a closed loop.

In the conduit 21, toner mixture is caused to flow downwardly by gravity through the hollows of the coil sections 22*a* and 22*b* and be permeated by all lines of force of the coil 22.

In summary, a toner density sensor of the present invention overcomes the drawbacks of the prior art by providing a coil inside a conduit through which toner mixture is caused to flow. The present sensor is not influenced by toner dust or other ferromagnetic bodies outside the conduit since the magnetic lines of force of the coil are confined within the conduit. The sensitivity is greatly increased since all magnetic lines of force of the coil pass through the toner mixture in the conduit. Various modifications will become possible for those skilled in the art after receiving the teachings of the present disclosure without departing from the scope thereof.

What is claimed is:

1. A toner density sensor comprising:

a conduit through which a toner mixture of ferromagnetic carrier particles and non-magnetic toner particles is caused to flow; and an electromagnetic coil disposed inside the conduit, said coil being constructed and arranged so that the magnetic lines of force of the coil are substantially confined within the conduit, the effective inductance of the coil varying in accordance with the toner density which is a ratio of toner particles to carrier particles in the toner mixture, said coil comprising two hollow, flattened coil sections which are symmetrically transversely disposed in the conduit, the axes of the coil sections being generally parallel to an axis of the conduit.

2. A sensor as in claim 1, in which the coil sections are elongated along the axis of the conduit and are convexly curved away from each other.

3. A sensor as in claim 1, in which outer surfaces of the coil sections are flush with inner surfaces of the conduit, the sensor further comprising means for preventing flow of toner mixture between the coil sections.

4. A sensor as in claim 3 in which said means comprises a spacer.

5. A sensor as in claim 1, in which the coil sections are arranged so that current flow therethrough causes generation of magnetic lines of force extending in opposite directions respectively which are generally parallel to the axis of the conduit, the magnetic fields combining to form a closed loop.

* * * * *